US012637823B2

(12) United States Patent
El-Awar

(10) Patent No.: US 12,637,823 B2
(45) Date of Patent: May 26, 2026

(54) HELICAL PILE DEVICE

(71) Applicant: Raja S. El-Awar, Cockeysville, MD (US)

(72) Inventor: Raja S. El-Awar, Cockeysville, MD (US)

( * ) Notice: Subject to any disclaimer, the term of this patent is extended or adjusted under 35 U.S.C. 154(b) by 81 days.

(21) Appl. No.: 18/662,109

(22) Filed: May 13, 2024

(65) Prior Publication Data

US 2025/0223771 A1 Jul. 10, 2025

Related U.S. Application Data

(60) Provisional application No. 63/618,366, filed on Jan. 7, 2024.

(51) Int. Cl.
*E02D 5/56* (2006.01)

(52) U.S. Cl.
CPC ..... *E02D 5/56* (2013.01)

(58) Field of Classification Search
CPC .. E02D 5/56; E02D 5/801; E02D 7/22; E04H 12/2223
See application file for complete search history.

(56) References Cited

U.S. PATENT DOCUMENTS 3,235,018 A * 2/1966 Troeppl ..... E02F 9/2866 175/391
5,143,163 A * 9/1992 Stiffler ..... E21B 10/44 299/87.1
5,476,149 A * 12/1995 Rickards ..... E21B 10/44 175/391
7,357,200 B2 * 4/2008 Harleman ..... E21B 10/44 175/323
8,418,784 B2 * 4/2013 Hall ..... E21B 10/44 175/323
8,661,640 B2 * 3/2014 Parrott ..... E21C 35/197 29/252
2004/0118615 A1 * 6/2004 Beach ..... E21C 35/197 299/102
2010/0263929 A1 * 10/2010 Ditillo ..... E02D 5/36 175/19
2016/0145824 A1 * 5/2016 Lutenegger ..... E02D 5/801 405/252.1

(Continued)

FOREIGN PATENT DOCUMENTS

GB 2418949 A * 4/2006 ..... E02D 5/56

*Primary Examiner* — Benjamin F Fiorello
(74) *Attorney, Agent, or Firm* — PATENTFILE, LLC; Bradley C. Fach; Steven R. Kick

(57) ABSTRACT

A helical pile device may include an elongated shaft having an exterior surface, an upper end, and a lower end. A flight blade having a helix shape may be coupled to the exterior surface of the elongated shaft proximate to the lower end, and the flight blade may have a leading edge and a trailing edge. Preferably, the flight blade may have an outer edge, and the outer edge may be between 85% to 115% of one complete helix turn. A tooth coupler may be coupled to the leading edge of the flight blade, and the tooth coupler may have a tooth channel. The tooth channel may have a channel axis, and the channel axis may extend below the leading edge of the flight blade. One or more pile teeth may be coupled to the leading edge of the flight blade, optionally by being coupled to a tooth coupler.

14 Claims, 7 Drawing Sheets

(56) References Cited

U.S. PATENT DOCUMENTS

| | | | | |
|---|---|---|---|---|
| 2016/0186403 | A1* | 6/2016 | Tomchesson | E02D 5/54<br>405/252.1 |
| 2019/0271131 | A1* | 9/2019 | Perko | E02D 5/56 |
| 2021/0310209 | A1* | 10/2021 | Yang | E02D 5/223 |
| 2022/0228445 | A1* | 7/2022 | Ishizuka | E02D 5/56 |

* cited by examiner

HELICAL PILE DEVICE

CROSS REFERENCE TO RELATED APPLICATIONS

This application claims priority to and the benefit of the filing date of U.S. Provisional Application No. 63/618,366, filed on Jan. 8, 2024, entitled "HELICAL PILE SYSTEMS, APPARATUS, AND METHODS", which is hereby incorporated by reference in its entirety.

FIELD OF THE INVENTION

This patent specification relates to the field of helical piles. More specifically, this patent specification relates to a helical pile device that provides improved engagement with soil, fill, weather rock, and other substrates.

BACKGROUND

Helical piles, sometimes referred to as screw-piles, screw piers, screw anchors, screw foundations, ground screws, screw piles, helical piers, or helical anchors are a steel screw-in piling and ground anchoring system used for building deep foundations and retaining walls. Screw piles are typically manufactured from high-strength steel using varying sizes of square shafts or tubular hollow sections with helical flights. Generally, the pile shaft transfers a structure's/wall load into the pile/anchor. Helical steel plates are welded to the pile shaft to suit the site specific ground conditions. Helices can be press-formed to a specified pitch or simply consist of flat plates welded at a specified pitch to the pile's shaft. The number of helices, their diameters and position on the pile shaft as well as steel plate thickness are all determined based on the specific use application of the helical pile. However, existing helical piles are not suited for engaging with hard soil substrates, such as rock, since these hard soil substrates can damage the helical steel plates.

Helical piles are different from augers and are used for completely different applications. Helical piles are built and purposed to screw into a soil substrate without removing the soil substrate from the ground, as the helical pile relies on the weight of the soil substrate that is above the helical plates in order to secure the pile within the ground to enable it to perform its anchoring and deep foundation element functions. Conversely, augers are designed to completely disturb the soil substrate that they move through in order to remove the solid substrate that they contact from the ground.

Therefore, a need exists for a novel helical pile device. A further need exists for a novel helical pile device that provides improved engagement with soil/rock substrates and that does not suffer from the drawbacks of existing helical piles.

BRIEF SUMMARY OF THE INVENTION

A helical pile device is provided that is configured for improved engagement with soil substrates, including rocky and hard soil substrates, and that does not suffer from the drawbacks of existing helical piles.

In some embodiments, the helical pile device may include an elongated shaft having an exterior surface, an upper end, and a lower end. A flight blade having a helix shape may be coupled to the exterior surface of the elongated shaft proximate to the lower end, and the flight blade may have a leading edge and a trailing edge. A tooth coupler may be coupled to the leading edge of the flight blade, and the tooth coupler may have a tooth channel. The tooth channel may have a channel axis, and the channel axis may extend below the leading edge of the flight blade.

In further embodiments, the helical pile device may include an elongated shaft having an exterior surface, an upper end, and a lower end. A flight blade having a helix shape may be coupled to the exterior surface of the elongated shaft proximate to the lower end, and the flight blade may have a leading edge and a trailing edge. The flight blade may have an outer edge, and the outer edge may be between 85% to 115% of one complete helix turn. One or more pile teeth may be coupled to the leading edge of the flight blade.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
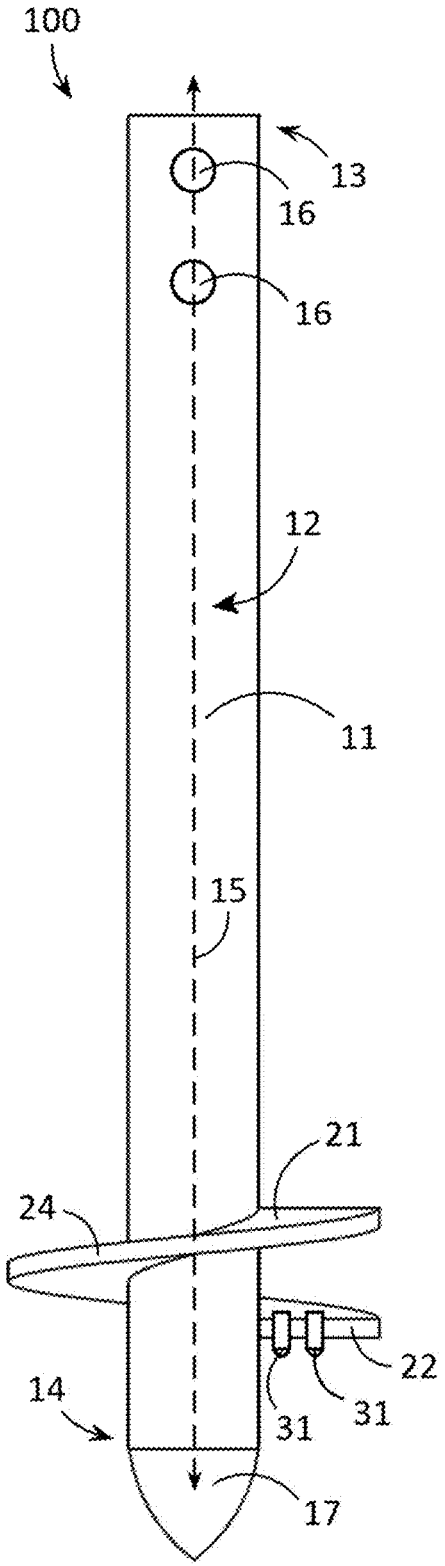
FIG. 1 depicts a first side schematic view of an example of a helical pile device according to various embodiments described herein.
Figure 2:
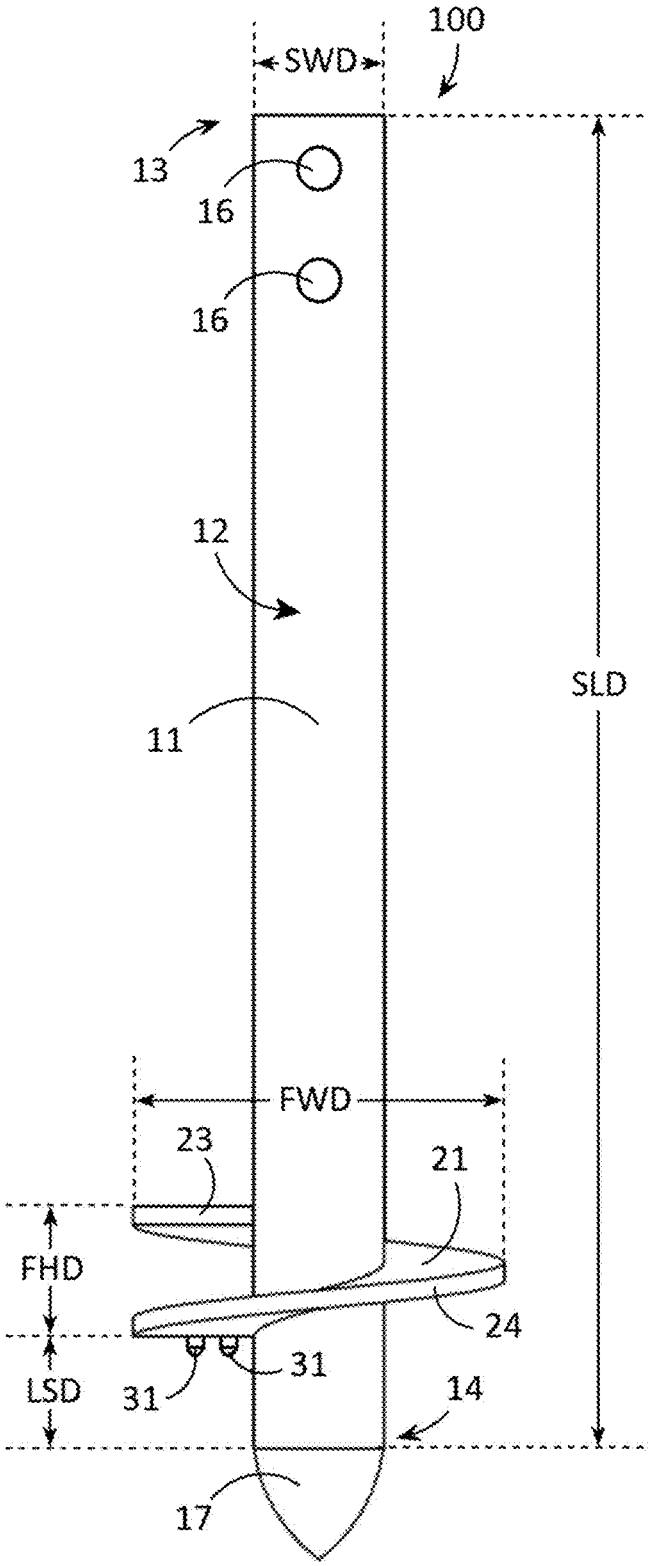
FIG. 2 illustrates a second side schematic view of an example of a helical pile device according to various embodiments described herein.
Figure 3:
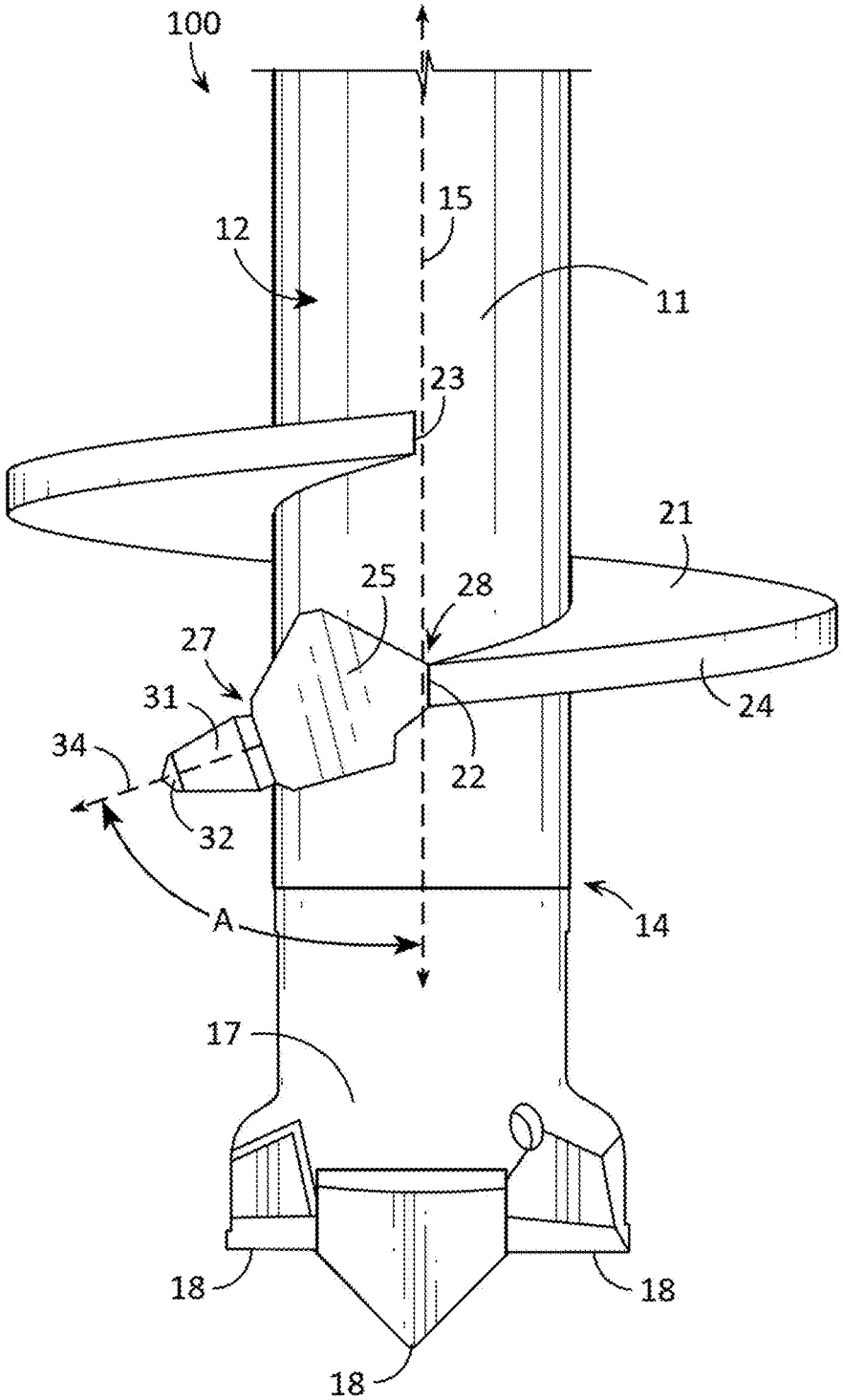
FIG. 3 shows a first side elevation view of an example of a helical pile device according to various embodiments described herein.
Figure 4:
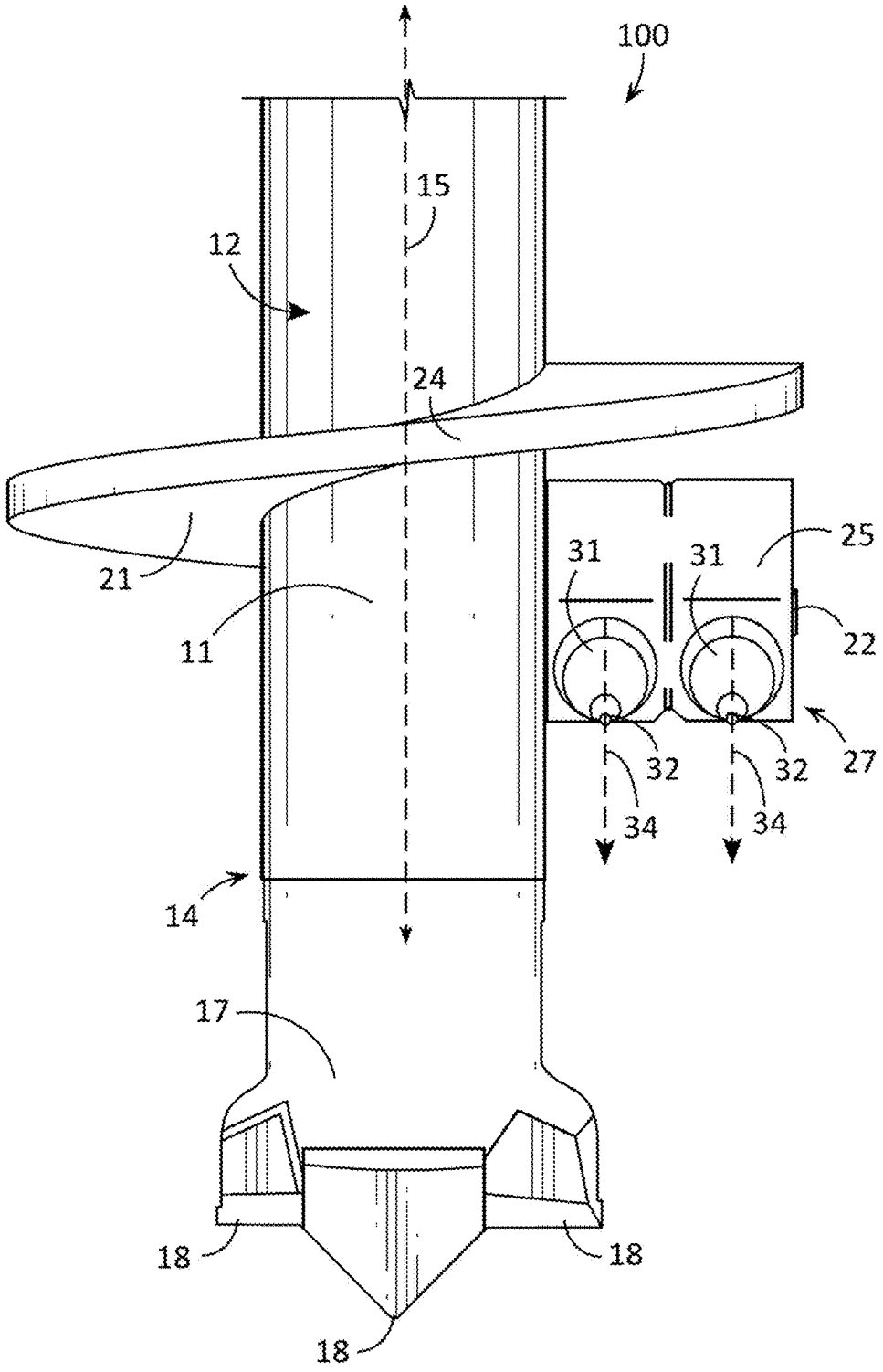
FIG. 4 depicts a second side elevation view of an example of a helical pile device according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 20% of the specified number. Additionally, as used in this application, the term "substantially" means that the actual value is at or within 10% of the actual desired value, more preferably at or within 5% of the actual desired value and even more preferably at or within 1% of the actual desired value of any variable, element or limit set forth herein.

A new helical pile device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-4 illustrate examples of a helical pile device ("the device") 100 according to various embodiments. In some embodiments, the device 100 may comprise an elongated shaft 11 having an exterior surface 12, an upper end 13, and a lower end 14. A flight blade 21, having a helix shape, may be coupled to the exterior surface 12 of the elongated shaft 11 proximate to the second end 12. The flight blade 21 may have a leading edge 22 and a trailing edge 23, and one or more pile teeth 31 may be coupled to the leading edge 22 of the flight blade 21, preferably via a tooth coupler 25 that is coupled to the leading edge 22 of the flight blade 21.

The device 100 may comprise an elongated shaft 11 having an upper end 13 and a lower end 14 so that the upper end 13 and a lower end 14 may be opposingly positioned on the elongated shaft 11. The elongated shaft 11 may comprise a shaft length dimension (SLD) (FIG. 2) which may describe the maximum distance between the upper end 13 and a lower end 14 so that the SLD may describe the elongated dimension of the elongated shaft 11. In some embodiments, the elongated shaft 11 may comprise a shaft width dimension (SWD) (FIG. 2) which may describe the maximum width of the elongated shaft 11. As an example, an elongated cylindrical shaped elongated shaft 11, the SWD may be the outer diameter of the elongated shaft 11. In preferred embodiments, the SWD may be between 2.5 inches and 8.0 inches, such as by being approximately 4.5 inches, such as by being approximately 3.5 inches, such as by being approximately 2.875 inches, etc.

An elongated shaft 11 may comprise any shape, and preferably an elongated shape, having a length substantially greater than its width and height. In some embodiments, an elongated shaft 11 may comprise an elongated cylindrical shape. In other embodiments, an elongated shaft 11 may comprise an elongated triangular prism shape, an elongated rectangular prism shape, an elongated oval shape, an elongated hexagonal prism shape, or any other shape including combinations of shapes. For example, the majority and central portion of an elongated shaft 11 may comprise an elongated rectangular prism shape, while each end of the elongated shaft 11 may comprise a generally cylindrical shape. In some embodiments, an elongated shaft 11 may comprise one or more shaft coupling apertures 16 which may be configured to receive fasteners or other coupling devices and methods that may be used to couple the elongated shaft 11 to a rotational motivator (for rotating the device 100 into a soil substrate) and/or to a pilot bit 17. For example, an elongated shaft 11 may comprise two sets of two shaft coupling apertures 16, in which each set is positioned on opposite sides of the elongated shaft 11, which may be positioned proximate to the upper end 13, and the upper shaft coupling aperture 16 of both sets may be positioned approximately 1.5 inches below the upper end 13 and the lower shaft coupling aperture 16 of both sets may be positioned approximately 5.5 inches below the upper end 13.

In preferred embodiments, an elongated shaft 11 may comprise or may be made from galvanized steel, and more preferably using approximately 80 kilo-pound per square inch (KSI) yield strength steel. In further embodiments, an elongated shaft 11 may comprise or may be made from other metal alloys that are suitable for contacting and motivating a flight blade 21 into a soil substrate. Preferably, an elongated shaft 11 may comprise corrosion protection that conforms to American Society for Testing Materials (ASTM) A123 standard specification for hot zinc (galvanized) coating. In some embodiments, an elongated shaft 11 may comprise a hollow cylindrical configuration having a pipe wall thickness of between approximately 0.25 to 0.40 inches in thickness, such as approximately 0.276 inches in thickness, approximately 0.337 inches in thickness, approximately 0.368 inches in thickness, etc.

The device 100 may comprise one or more flight blades 21 which may be coupled to the exterior surface 12 of the elongated shaft 11 proximate to the second end 12. A flight blade 21 may comprise a leading edge 22, a trailing edge 23, and an outer edge 24. A leading edge 22 may comprise the portion of the flight blade 21 that may be closest to the second end 12, while a trailing edge 23 may comprise the portion of the flight blade 21 that may be closest to the upper end 13. In preferred embodiments, a leading edge 22 may be beveled approximately 45 degrees, such as between 36 and 54 degrees. In preferred embodiments, a flight blade 21 may be made from ASTM A36 hot rolled plate steel 0.5 inch stock, while in other embodiments, a flight blade 21 may be made from or may comprise other metal alloys that are suitable for contacting and being retained in a soil substrate.

In preferred embodiments, a flight blade 21 may comprise a helix shape in which the elongated shaft 11 functions as the fixed axis for the helix shape. A helix is a shape like the cylindrical part of a coil spring or machine screw. It is a type of smooth space curve with tangent lines at a constant angle to a fixed axis. A circular helix (i.e. one with constant radius) has substantially constant band curvature and substantially constant torsion. In preferred embodiments, a flight blade 21 may comprise a circular helix shape, and may have an outer edge 24 which may comprise a helix shape and more preferably, a circular helix shape. In further preferred embodiments, the outer edge 24 of a flight blade 21 may be between 85% to 115% of one complete helix turn, such as substantially 100% of one complete helix turn. In further preferred embodiments, a flight blade 21 may encircle between 85% to 115%, such as substantially 100%, of the exterior surface 12 of the elongated shaft 11 (encircle in a direction that is substantially perpendicular to the elongated dimension, i.e., the shaft length dimension (SLD), of the elongated shaft 11).

In some embodiments, a flight blade 21 may comprise a flight width dimension (FWD) (FIG. 2) which may describe the maximum diameter distance of the outer edge 24 of the flight blade 21. In preferred embodiments, a flight blade 21 may comprise a flight width dimension (FWD) that may be between approximately 5.0 and 15.0 inches, such as substantially 10.0 inches. In preferred embodiments, the flight width dimension (FWD) (FIG. 2) of the flight blade 21 may be between 50% and 115% of the shaft width dimension SWD of the elongated shaft 21. For example, the SWD may be 3.0 inches and the FHD may be 3.0 inches. In further embodiments, the flight width dimension (FWD) may be between approximately 5.0 and 60.0 inches.

In some embodiments, a flight blade 21 may be configured with a thickness (thickness of the outer edge 24) that may be between 0.20 inches and 1.0 inches, and more preferably with a thickness of approximately 0.50 inches.

A flight blade 21 may be coupled to the exterior surface 12 of the elongated shaft 11 proximate to the second end 12. The device 100 may comprise a leading edge separation distance (LSD) (FIG. 2) which may describe the distance between the leading edge 22 of the flight blade 21 and the second end 12 of the elongated shaft 11. In preferred embodiments, the flight blade 21 may be coupled to the exterior surface 12 of the elongated shaft 11 proximate to the second end 12 so that the LSD may be between 1.5 inches and 5.0 inches, such as substantially 3.0 inches. In some embodiments, a flight blade 21 may comprise a flight height dimension (FHD) (FIG. 2) which may describe the distance that the flight blade 21 extends along the shaft length dimension (SLD). In preferred embodiments, the flight height dimension (FHD) of the flight blade 21 may be between 5.0% and 11% of the shaft length dimension (SLD) of the elongated shaft 21. For example, the SLD may be 36.0 inches and the FHD may be 3.0 inches. In further embodiments, the flight height dimension (FHD) of the flight blade 21 may be between 6.0 to 50.0 inches.

In some embodiments, the device 100 may comprise one or more pile teeth 31 which may be coupled to the leading edge 22 of the flight blade 21. In some embodiments, a pile tooth 31 may be coupled, and more preferably removably coupled, directly to the leading edge 22 of the flight blade 21. In further embodiments, a pile tooth 31 may be coupled, and more preferably removably coupled, to the leading edge 22 of the flight blade 21 by being coupled, and more preferably removably coupled, to a tooth coupler 25 that is coupled to the leading edge 22 of the flight blade 21.

A pile tooth 31 may comprise a Heat Treated Carbide Tooth for Rock Drilling Tunneling and Concrete boring, such as a C31 tooth. In preferred embodiments, a pile tooth 31 may comprise a tooth tip 32 and a tooth shaft 33. A tooth tip 32 may comprise the forward facing portion of the pile tooth 31 that is configured to first contact material that the pile tooth 31 is to move through. As an example, a tooth tip 32 may comprise a sharp tungsten carbide tip. A tooth shaft 33 may comprise a preferably cylindrical shaft that is configured to be coupled to the object that the pile tooth 31 is to be coupled to. Preferably, a tooth shaft 33 may be inserted into and secured within the object that the pile tooth 31 is to be coupled to. In preferred embodiments, a pile tooth 31 may be coupled, and more preferably removably coupled, to a tooth coupler 25 by inserting the tooth shaft 33 into a tooth channel 26 of the tooth coupler 25, such as via a frictional fit, a pin or other fastener, etc. A pile tooth 31 may also comprise a tooth axis 34 that may extend through the center of the tooth tip 32 and the center of the tooth shaft 33. Generally, a tooth axis 34 may extend centrally though the longest dimension of the pile tooth 31.

In some embodiments, the device 100 may comprise a first pile tooth 31 coupled to the leading edge 22 of the flight blade 21, and the first pile tooth 31 may have a first tooth tip 32 that is below the leading edge 22 of the flight blade 21. In further embodiments, the device 100 may comprise a second pile tooth 31 coupled to the leading edge 22 of the flight blade 21, and the second pile tooth 31 may have a second tooth tip 32 that is below the leading edge 22 of the flight blade 21.

In some embodiments, the device 100 may comprise a first pile tooth 31 coupled to the leading edge 22 of the flight blade 21, and the first pile tooth 31 may have a first tooth axis 34. Preferably, the first tooth axis 34 may be angled between 75 and 90 degrees relative to the shaft axis 15 as shown with angle A in FIG. 3. In further embodiments, the device 100 may comprise two or more pile teeth 31 coupled to the leading edge 22 of the flight blade 21, and the tooth axis 34 of each pile tooth 31 may be angled between 75 and 90 degrees relative to the shaft axis 15.

In some embodiments, the device 100 may comprise a first pile tooth 31 and a second pile tooth 31 that are coupled to the leading edge 22 of the flight blade 21. The first pile tooth 31 may have a first tooth axis 34, and the second pile tooth 31 may have a second tooth axis 34. Preferably, the first tooth axis 34 may be substantially parallel (plus or minus five degrees) to the second tooth axis 34 as perhaps best shown in FIG. 4. In further embodiments, a first tooth axis 34 may be approximately parallel (plus or minus fifteen degrees) to a second tooth axis 34. In further embodiments, a first tooth axis 34 may be angled between 15.0 and 45.0 degrees relative to a second tooth axis 34.

In preferred embodiments, the device 100 may comprise a tooth coupler 25 which may be coupled to the leading edge 22 of the flight blade 21 and which may be configured to be coupled, and more preferably removably coupled, to one or more pile teeth 31. A tooth coupler may comprise a front end 27 and an opposing back end 28. The back end 28 may be coupled to the leading edge 22 of the flight blade 21, and the front end 27 may comprise one or more tooth channels 26.

In some embodiments, a tooth coupler 25 may comprise one or more tooth channels 26 that may be sized and shaped to receive all or portion of a tooth shaft 33 of a pile tooth 31. As an example, a tooth coupler 25 may comprise a tooth block having a cylindrical tooth channel 26 that may accept and be removably coupled to a cylindrical tooth shaft 33 of a C31 type pile tooth 31.

Figure 5:
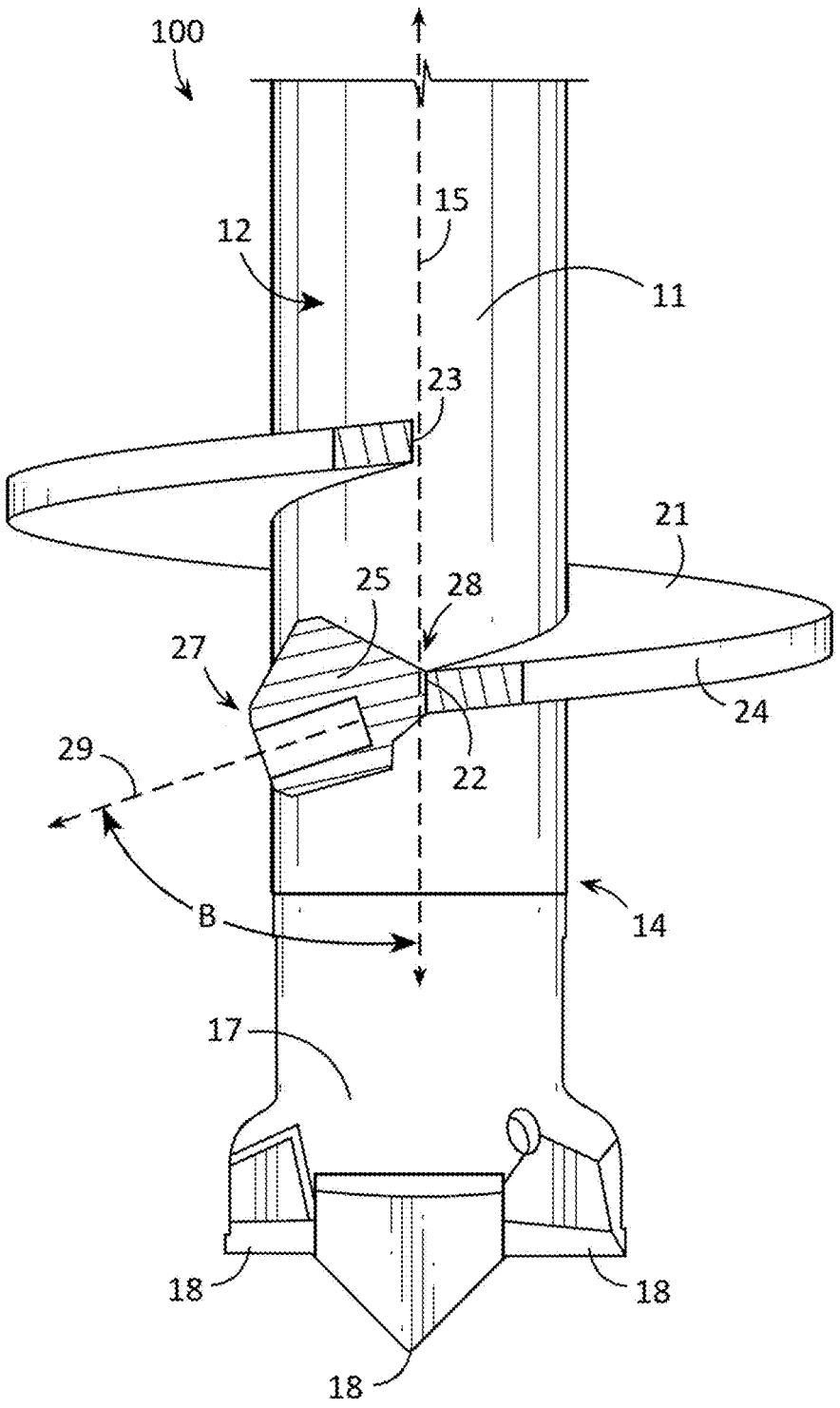
FIG. 5 illustrates a sectional, through line 5-5 shown in FIG. 6, elevation view of another example of a helical pile device according to various embodiments described herein.
Figure 6:
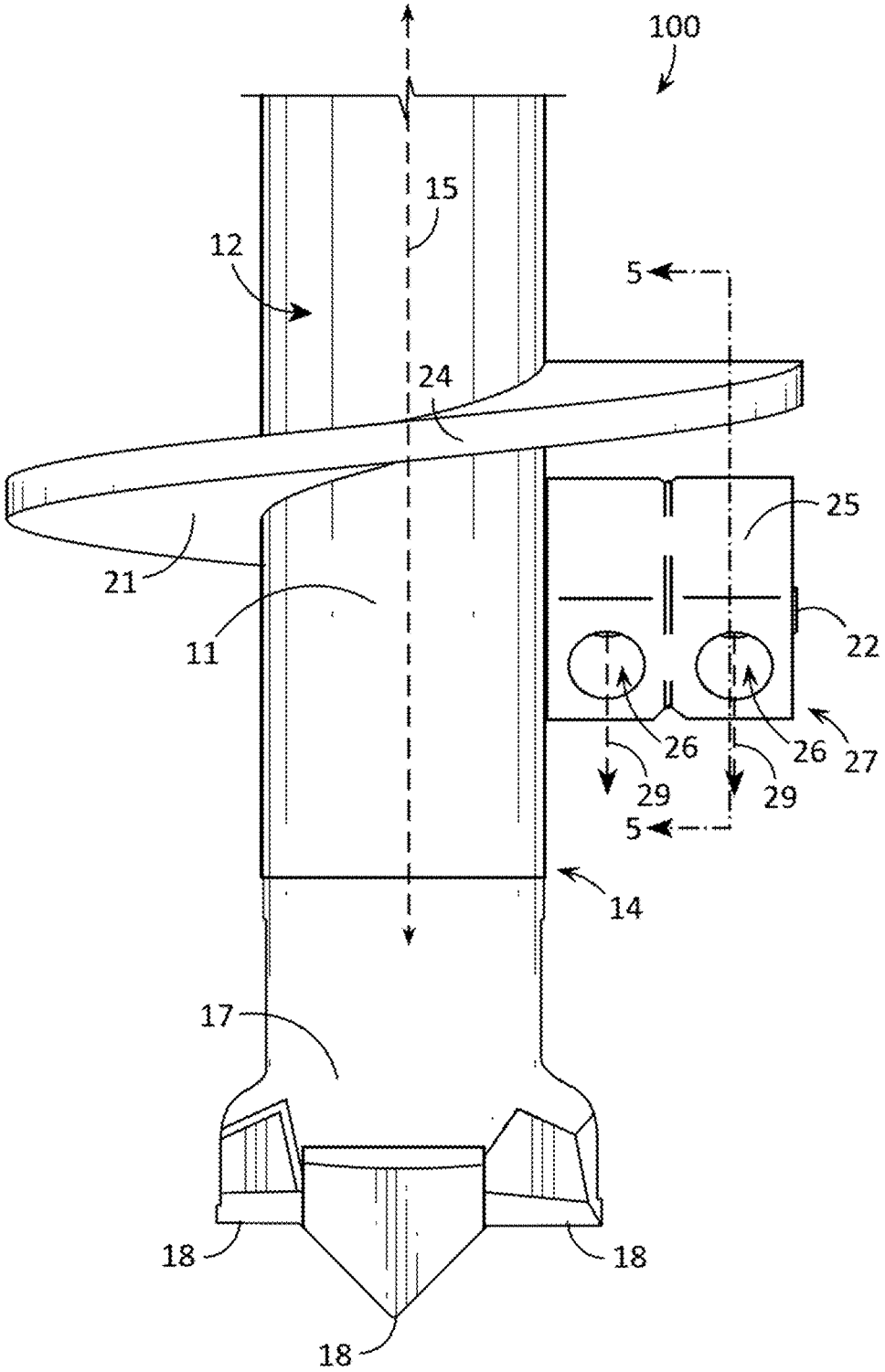
FIG. 6 shows a side elevation view of another example of a helical pile device according to various embodiments described herein.
Figure 7:
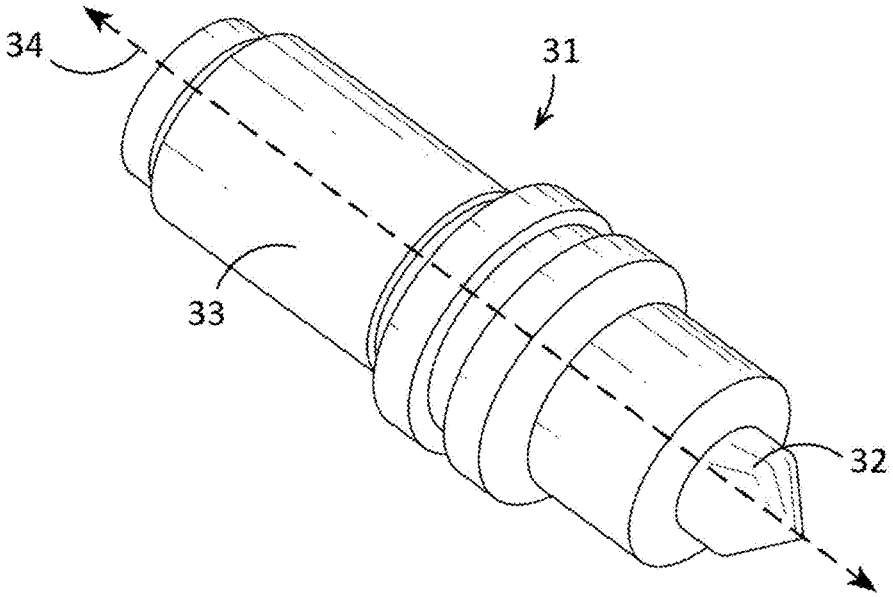
FIG. 7 depicts a perspective view of an example of a pile tooth according to various embodiments described herein.
Figure 8:
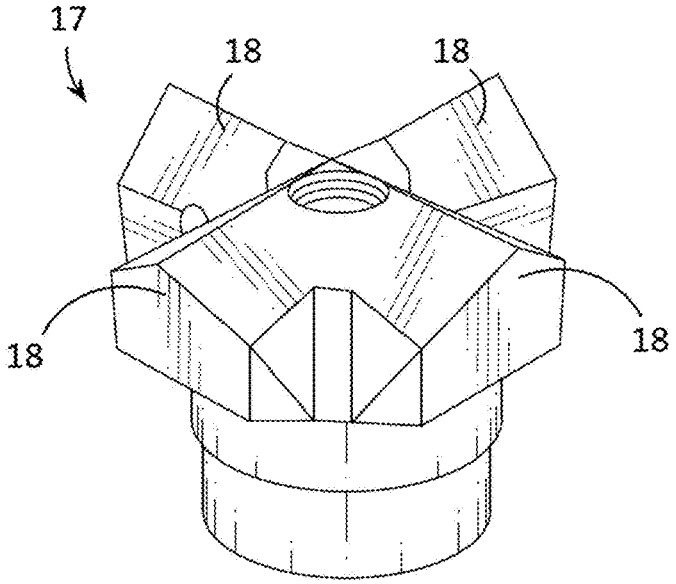
FIG. 8 illustrates a perspective view of an example of a pilot bit according to various embodiments described herein.

A tooth channel 26 of a tooth coupler 25 may comprise a channel axis 29 which may extend through the center of the tooth channel 26, generally towards the back end 28 of the tooth coupler 25 and out the front end 27 of the tooth coupler 25 through the tooth channel 26. In preferred embodiments, the channel axis 29 of one or more, such as each, tooth channel 26 may extend below (below as in generally away from the upper end 13 and generally towards the lower end 14) the leading edge 22 of the flight blade 21. In further preferred embodiments, the channel axis 29 of one or more, such as each, tooth channel 26 may be angled between 75 and 90 degrees relative to the shaft axis 15 as shown with angle B in FIG. 5. In further preferred embodiments, a tooth coupler 25 may comprise two tooth channels 26, and the channel axis 29 of the first tooth channel 26 may be substantially parallel (plus or minus five degrees) to the channel axis 29 of the second tooth channel 26 as perhaps best shown in FIG. 6. In further embodiments, a first channel axis 29 may be approximately parallel (plus or minus fifteen degrees) to a second channel axis 29. In further embodiments, a first channel axis 29 may be angled between 15.0 and 45.0 degrees relative to a second channel axis 29.

In some embodiments, the device 100 may comprise a first pile tooth 31 coupled to a tooth coupler 25 that is coupled to the leading edge 22 of the flight blade 21, and the first pile tooth 31 may have a first tooth tip 32 that is below the leading edge 22 of the flight blade 21. In further embodiments, the device 100 may comprise a second pile tooth 31 coupled to the tooth coupler 25 that is coupled to the leading edge 22 of the flight blade 21, and the second pile tooth 31 may have a second tooth tip 32 that is below the leading edge 22 of the flight blade 21.

In some embodiments, the device 100 may comprise a first pile tooth 31 coupled to a tooth coupler 25 that is coupled to the leading edge 22 of the flight blade 21, and the first pile tooth 31 may have a first tooth axis 34. Preferably, the first tooth axis 34 may be angled between 75 and 90 degrees relative to the shaft axis 15 as shown with angle A in FIG. 3. In further embodiments, the device 100 may comprise two or more pile teeth 31 coupled to a tooth coupler 25 that is coupled to the leading edge 22 of the flight blade 21, and the tooth axis 34 of each pile tooth 31 may be angled between 75 and 90 degrees relative to the shaft axis 15.

In some embodiments, the device 100 may comprise a first pile tooth 31 and a second pile tooth 31 that are coupled to a tooth coupler 25 that is coupled to the leading edge 22 of the flight blade 21. The first pile tooth 31 may have a first tooth axis 34, and the second pile tooth 31 may have a second tooth axis 34. Preferably, the first tooth axis 34 may be substantially parallel (plus or minus five degrees) to the second tooth axis 34 as perhaps best shown in FIG. 4.

In some embodiments, the device 100 may comprise a pilot bit 17 which may be coupled, and more preferably removably coupled, to the lower end 14 of the elongated shaft 11. A pilot bit 17 may be configured in any size and shape. In preferred embodiments, a pilot bit 17 may comprise a cross-cut drill bit, such as which may comprise four intersecting tungsten carbide cutting blades 18. In further embodiments, a pilot bit 17 may comprise a hardened cross-cut drill bit, a two stage cross-cut drill bit, a tungsten carbide hemispherical button drill bit, an offset face cross-cut drill bit, or any other type of soil substrate drill bit. Optionally, a pilot bit 17 may be removably coupled to the lower end 14 of the elongated shaft 11 via a pin, bolt, or other fastener that may be inserted through a pilot bit 17 and through the shaft coupling aperture 16 that is proximate to the lower end 14, although any other suitable coupling method may be used.

While some exemplary shapes and sizes have been provided for elements of the device 100, it should be understood to one of ordinary skill in the art that the elongated shaft 11, flight blade 21, pile teeth 31, pilot bit 17 and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A helical pile device, the device comprising:

an elongated shaft having an exterior surface, an upper end, and a lower end, wherein the elongated shaft has a shaft axis;

a flight blade having a helix shape, wherein the flight blade is coupled to the exterior surface of the elongated shaft proximate to the lower end, wherein the flight blade has a leading edge and a trailing edge;

a tooth coupler coupled to the leading edge of the flight blade, the tooth coupler having a tooth channel, wherein the tooth channel comprises a channel axis, and wherein the channel axis extends below the leading edge of the flight blade;

a pilot bit removably coupled to the lower end of the elongated shaft, wherein the pilot bit comprises a cross-cut drill bit having four intersecting cutting blades; and a first pile tooth and a second pile tooth coupled to the tooth coupler, wherein the first pile tooth and the second pile tooth each comprise a cylindrical tooth shaft and a tooth tip, wherein the first pile tooth has a first tooth axis, and wherein the first tooth axis is angled between 75 and 90 degrees relative to the shaft axis.

2. The device of claim 1, wherein the flight blade encircles between 85% to 115% of the exterior surface of the elongated shaft.

3. The device of claim 1, wherein the first pile tooth comprises a first tooth tip, and wherein the first tooth tip is below the leading edge of the flight blade.

4. The device of claim 1, wherein the first pile tooth comprises a first tooth tip, wherein the second pile tooth comprises a second tooth tip, and wherein the first tooth tip and the second tooth tip are below the leading edge of the flight blade.

5. The device of claim 1, wherein the first pile tooth is removably coupled to the tooth coupler.

6. The device of claim 1, wherein the flight blade comprises a height dimension, wherein the elongated shaft comprises a width dimension, and wherein the height dimension of the flight blade is between 50% and 115% of the width dimension of the elongated shaft.

7. The device of claim 1, wherein the flight blade comprises a height dimension, wherein the elongated shaft comprises a length dimension, and wherein the height dimension of the flight blade is between 5.0% and 11% of the length dimension of the elongated shaft.

8. A helical pile device, the device comprising:

an elongated shaft having an exterior surface, an upper end, and a lower end, wherein the elongated shaft has a shaft axis;

a flight blade having a helix shape, wherein the flight blade is coupled to the exterior surface of the elongated shaft proximate to the lower end, wherein the flight blade has a leading edge and a trailing edge, wherein the flight blade has an outer edge, and wherein the outer edge is between 85% to 115% of one complete helix turn;

a pilot bit removably coupled to the lower end of the elongated shaft, wherein the pilot bit comprises a cross-cut drill bit having four intersecting cutting blades; and a first pile tooth and a second pile tooth coupled to the leading edge of the flight blade, wherein the first pile tooth and the second pile tooth each comprise a cylindrical tooth shaft and a tooth tip, wherein the first pile tooth has a first tooth axis, and wherein the first tooth axis is angled between 75 and 90 degrees relative to the shaft axis.

9. The device of claim 8, wherein the flight blade encircles between 85% to 115% of the exterior surface of the elongated shaft.

10. The device of claim 8, wherein the first pile tooth comprises a first tooth tip, and wherein the first tooth tip is below the leading edge of the flight blade.

11. The device of claim 8, wherein the first pile tooth comprises a first tooth tip, wherein the second pile tooth comprises a second tooth tip, and wherein the first tooth tip and the second tooth tip are below the leading edge of the flight blade.

12. The device of claim 8, wherein the first pile tooth is removably coupled to the flight blade.

13. The device of claim 8, wherein the flight blade comprises a height dimension, wherein the elongated shaft comprises a width dimension, and wherein the height dimension of the flight blade is between 50% and 115% of the width dimension of the elongated shaft.

14. The device of claim 8, wherein the flight blade comprises a height dimension, wherein the elongated shaft comprises a length dimension, and wherein the height dimension of the flight blade is between 5.0% and 11% of the length dimension of the elongated shaft.

* * * * *